US005886714A

United States Patent [19]

Burney et al.

[11] Patent Number: 5,886,714

[45] Date of Patent: Mar. 23, 1999

[54] ACTUATION MECHANISM FOR TRANSLATIONAL WIPING OF A STATIONARY INKJET PRINTHEAD

[75] Inventors: David C. Burney, Ramona; W. Wistar Rhoads; Paul E. Martinson, both of Escondido; Patrick J. Chase, San Diego, all of Calif.; Richard A. Becker, Barcelona, Spain

[73] Assignee: Hewlett-Packard Company, Palo Alto, Calif.

[21] Appl. No.: 398,720

[22] Filed: Mar. 6, 1995

[51] Int. Cl.[6] ..... B41J 2/165

[52] U.S. Cl. ..... 347/33

[58] Field of Search ..... 347/23, 24, 30, 347/33

[56] References Cited

U.S. PATENT DOCUMENTS

| | | | |
|---|---|---|---|
| 4,577,203 | 3/1986 | Kawamura | 346/140 |
| 5,103,244 | 4/1992 | Gast et al. | 346/1.1 |
| 5,115,250 | 5/1992 | Harmon et al. | 346/1.1 |
| 5,148,203 | 9/1992 | Hirano | 346/139 R |
| 5,151,715 | 9/1992 | Ward et al. | 346/140 R |
| 5,155,497 | 10/1992 | Martin et al. | 347/33 |
| 5,182,582 | 1/1993 | Okamura | 346/140 R |
| 5,432,539 | 7/1995 | Anderson | 347/33 |
| 5,440,331 | 8/1995 | Grange | 347/32 |
| 5,450,105 | 9/1995 | Dangelo | 347/30 |
| 5,614,930 | 3/1997 | Osborne et al. | 347/33 |

FOREIGN PATENT DOCUMENTS

| | | | |
|---|---|---|---|
| 0585901A2 | 9/1994 | European Pat. Off. | B41J 2/165 |
| 0673772A1 | 9/1995 | European Pat. Off. | B41J 2/165 |
| 1-275049 | 11/1989 | Japan | 347/33 |
| 2-179757 | 7/1990 | Japan | 347/33 |
| 3-253347 | 11/1991 | Japan | B41J 2/165 |
| 4187445 | 7/1992 | Japan | B41J 2/165 |
| 6-15814 | 1/1994 | Japan | 347/33 |
| 59-45163 | 3/1994 | Japan | B41J 3/04 |

OTHER PUBLICATIONS

Dangelo et al; Print Cartridge Fixturing and Maintenance in the HP DesketJet1200C Printer; Hewlett–Packard Journal; Feb. 1994; pp 67–71.

*Primary Examiner*—Benjamin R. Fuller
*Assistant Examiner*—Michael Brooke
*Attorney, Agent, or Firm*—David S. Romney; Jerry R. Potts

[57] ABSTRACT

An inkjet printer has a printhead mounted in a carriage which periodically moves in a carriage scan direction to a stop position in a service station where an actuation device causes a wiper blade to move back and forth across ink orifices on a nozzle surface of the printhead during a wiping operation. The actuation device incorporates a rotating lead screw to impart transtlational motion to the wiper blade in a wiping direction orthogonal to the carriage scan direction. A clutching action prevents further movement of the wiper blade after completion of each wiping step. The actuation device is driven through a gear train from a motor such as a media advance motor. An ink spittoon is incorporated in the same service station for receiving ink generated during a spitting operation, and a scraper in the ink spittoon removes residual ink from the wiper blade.

32 Claims, 16 Drawing Sheets

| INKJET CARTRIDGES | FIRST SERVICE STATION | | | SECOND SERVICE STATION | | | |
|---|---|---|---|---|---|---|---|
| | SPIT | WIPE | SCRAPE | CAP | PRIME | – | – |
| BLACK PRINTHEAD | SPIT | – | – | CAP | PRIME | WIPE | SCRAPE |
| CYAN PRINTHEAD | SPIT | – | – | CAP | PRIME | WIPE | SCRAPE |
| MAGENTA PRINTHEAD | SPIT | – | – | CAP | PRIME | WIPE | SCRAPE |
| YELLOW PRINTHEAD | SPIT | – | – | CAP | PRIME | WIPE | SCRAPE |

ACTUATION MECHANISM FOR TRANSLATIONAL WIPING OF A STATIONARY INKJET PRINTHEAD

RELATED APPLICATIONS

This application is related to the following copending applications, all of which are assigned to the same assignee as the present case and are incorporated herein by reference:

U.S. application Ser. No. 08/145,261 entitled MIXED RESOLUTION PRINTING FOR COLOR AND MONOCHROME PRINTERS filed in the names of Donald G. Harris et al. on Oct. 29, 1993, now U.S. Pat. No. 5,450,105, granted Sep. 12, 1995.

U.S. application Ser. No. 08/056,326 entitled MANUAL PEN SELECTION FOR CLEARING NOZZLES WITHOUT REMOVAL FROM PEN CARRIAGE filed in the name of Michael T. Dangelo on Apr. 30, 1993;

U.S. application Ser. No. 08/225,039 entitled WIPING SYSTEM FOR INKJET PRINTER filed in the names of William H. Schwiebert et al. on Apr. 8, 1994;

U.S. application Ser. No. 08/224,918 entitled WET-WIPING TECHNIQUE FOR INKJET PRINTHEAD filed in the names of Amy Van Liew et al. on Apr. 8, 1994;

U.S. application Ser. No. 08/330,461 entitled ORTHOGONAL ROTARY WIPING SYSTEM FOR INKJET PRINTHEADS filed in the names of William S. Osborne, et al. on Oct. 28, 1994;

U.S. application Ser. No. 08/399,397 entitled CUSTOMIZED PRINTHEAD SERVICING FOR DIFFERENT PRINTER CONDITIONS filed in the names of Paul E. Martinson et al. on Mar. 6, 1995:

U.S. application Ser. No. 08/398,720 entitled TRANSLATIONAL WIPING TECHNIQUE FOR A STATIONARY INKJET PRINTHEAD filed in the names of Richard A. Becker, et al. on Mar. 6, 1995;

U.S. application Ser. No. 08/399,380 entitled INDEPENDENT WIPING/SPITTING STATION FOR INKJET PRINTHEAD filed in the names of Richard A. Becker, et al. on Mar. 6, 1995.

BACKGROUND OF THE INVENTION

This application relates generally to inkjet printing, and more particularly to online service station functions of spitting ink into a spittoon, wiping ink orifices, capping an array of nozzles on a printhead, and priming inkjet cartridges.

Some prior color inkjet pen cartridges functioned somewhat satisfactorily with no wiping and minimal capping. Other prior monochrome/color inkjet cartridges used in single cartridge printers were wiped and capped with relatively simple mechanisms of the type shown in U.S. Pat. No. 4,583,717. Complex problems arose when trying to service different types of printheads on multiple ink cartridges mounted together in a print carrriage, particularly when the ink cartridges have different types of color/black inks.

BRIEF SUMMARY OF THE INVENTION

An inkjet printer has a printhead mounted in a carriage which periodically moves in a carriage scan direction to a stop position in a service station where an actuation device causes a wiper blade to move in a back-and-forth cycle across ink orifices on a nozzle surface of the printhead during a wiping operation. The actuation device incorporates a rotating lead screw to impart translational motion to the wiper blade in a wiping direction orthogonal to the carriage scan direction. A clutching action prevents further movement of the wiper blade after completion of each wiping step, thereby allowing the wiper blade to remain in an idle position until the initiation of another wiping step. The actuation device is driven through a gear train from a motor such as a media advance motor.

An ink spittoon is incorporated in the same service station for receiving ink generated during a spitting operation, and a scraper in the ink spittoon removes residual ink from the wiper blade before and after each wiping cycle.

In a preferred form of the invention, the wiper blade provides sequential wiping by first drawing ink onto the nozzle surface from the ink orifices, and then wiping the ink from the nozzle surface.

A pair of cam rails assure proper positioning of the wiper blade in the service station during a wiping operation, while the service station itself is mounted on the same printer chassis portion as a print zone platen in order to achieve optimum positioning relative to the printhead.

Figure 16A:
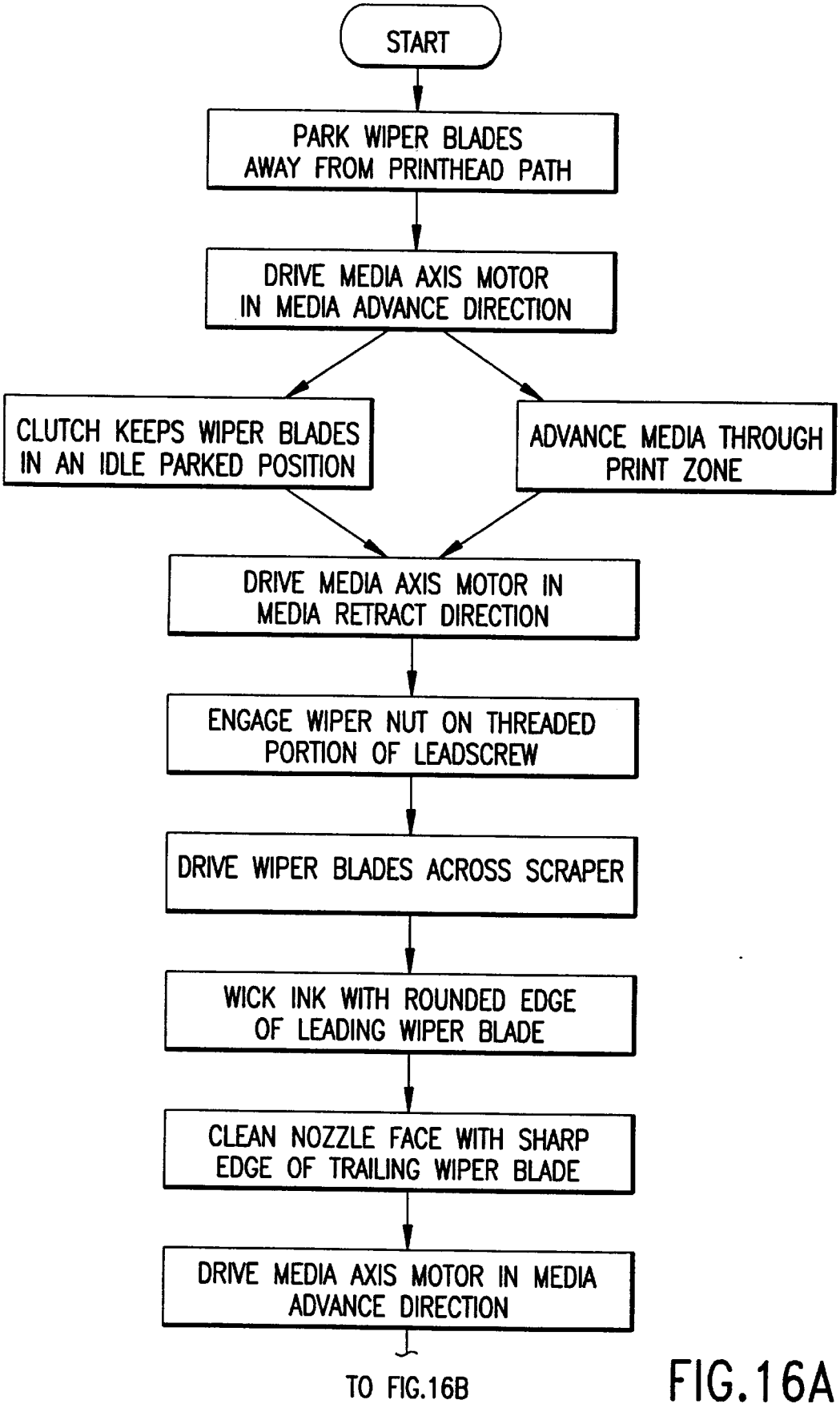
Figure 16B:
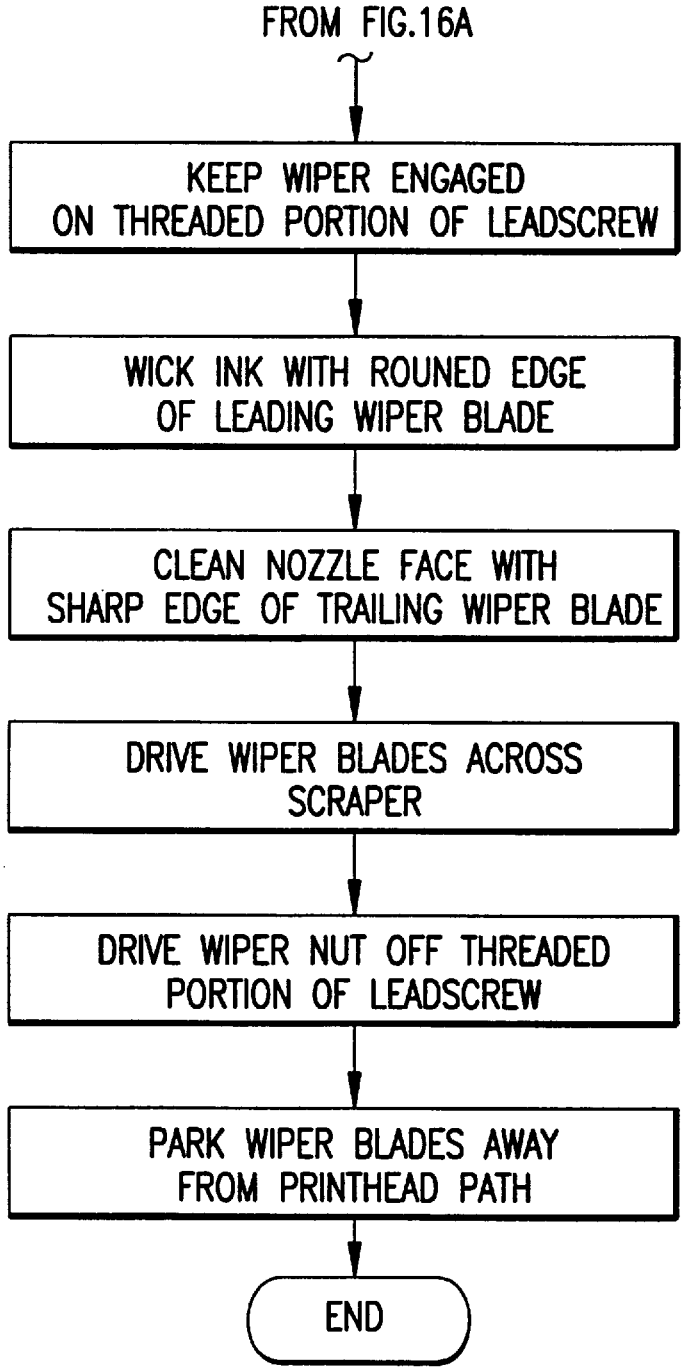
Figure 17:
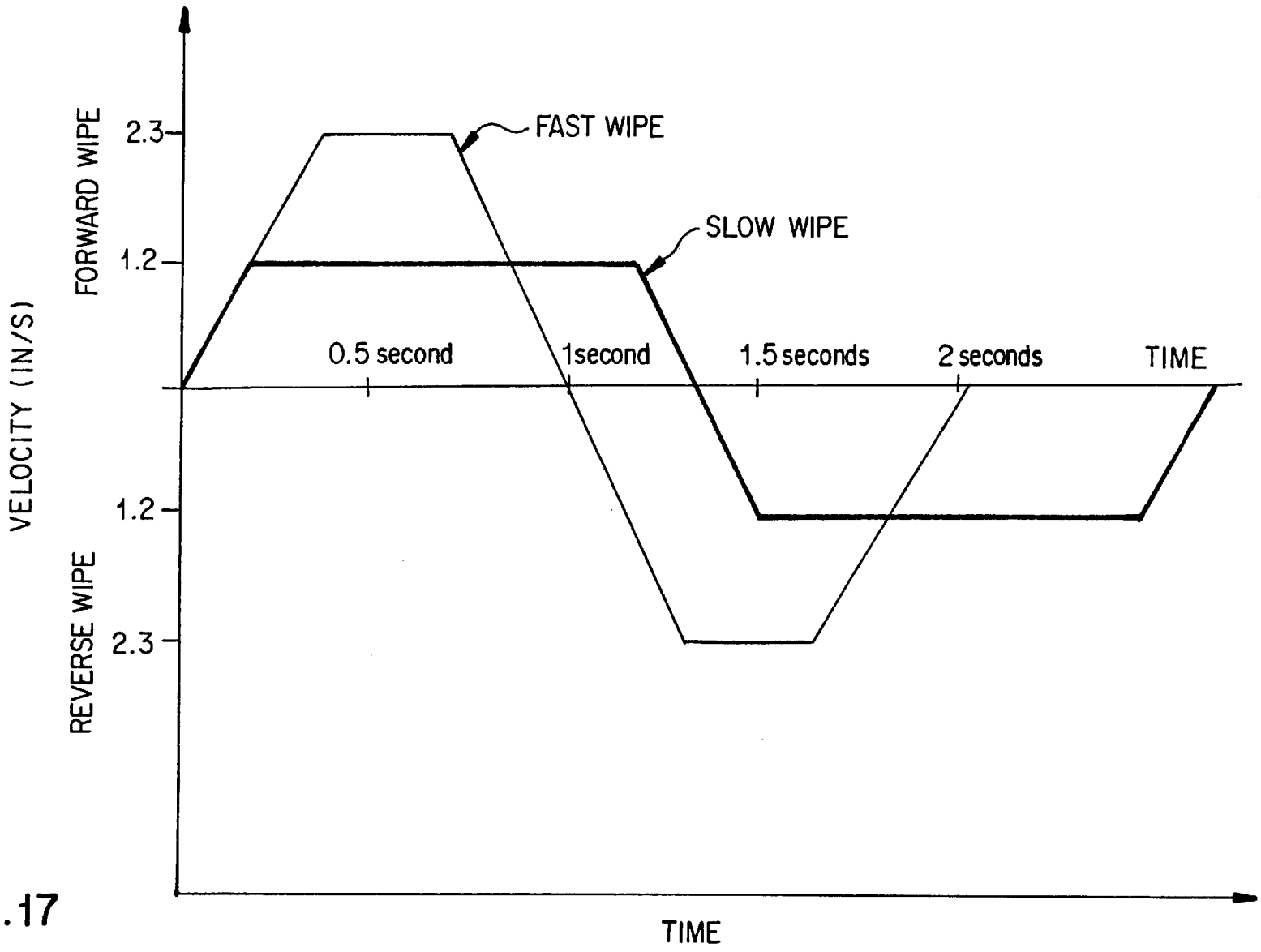

FIGS. 16A and 16B are a flow chart showing the service station methods and techniques of the first service station; and FIG. 17 is a timing diagram for a complete wiping cycle of the first service station.

DETAILED DESCRIPTION OF PREFERRED EMBODIMENTS

In a presently preferred embodiment of the invention disclosed herein, we have combined a 600 dpi ½ inch swath black pen with three 300 dpi color pens each generating a swath of approximately ⅓ inch. The high performance black pen has pigment based ink and is typically used for printing text and other "black only" features, and thus the output quality and throughput of these features is greater. It also improves the output quality of color graphics and color features by teaming with the three lower resolution color pens which have dye based inks for printing color graphics or color features. The black component of the graphics is often a large portion of color graphics content is at a higher resolution and thus at a higher output quality level. The larger swath of the black pen can thus be combined with printing algorithms to improve the throughput of color graphics.

Figure 1:
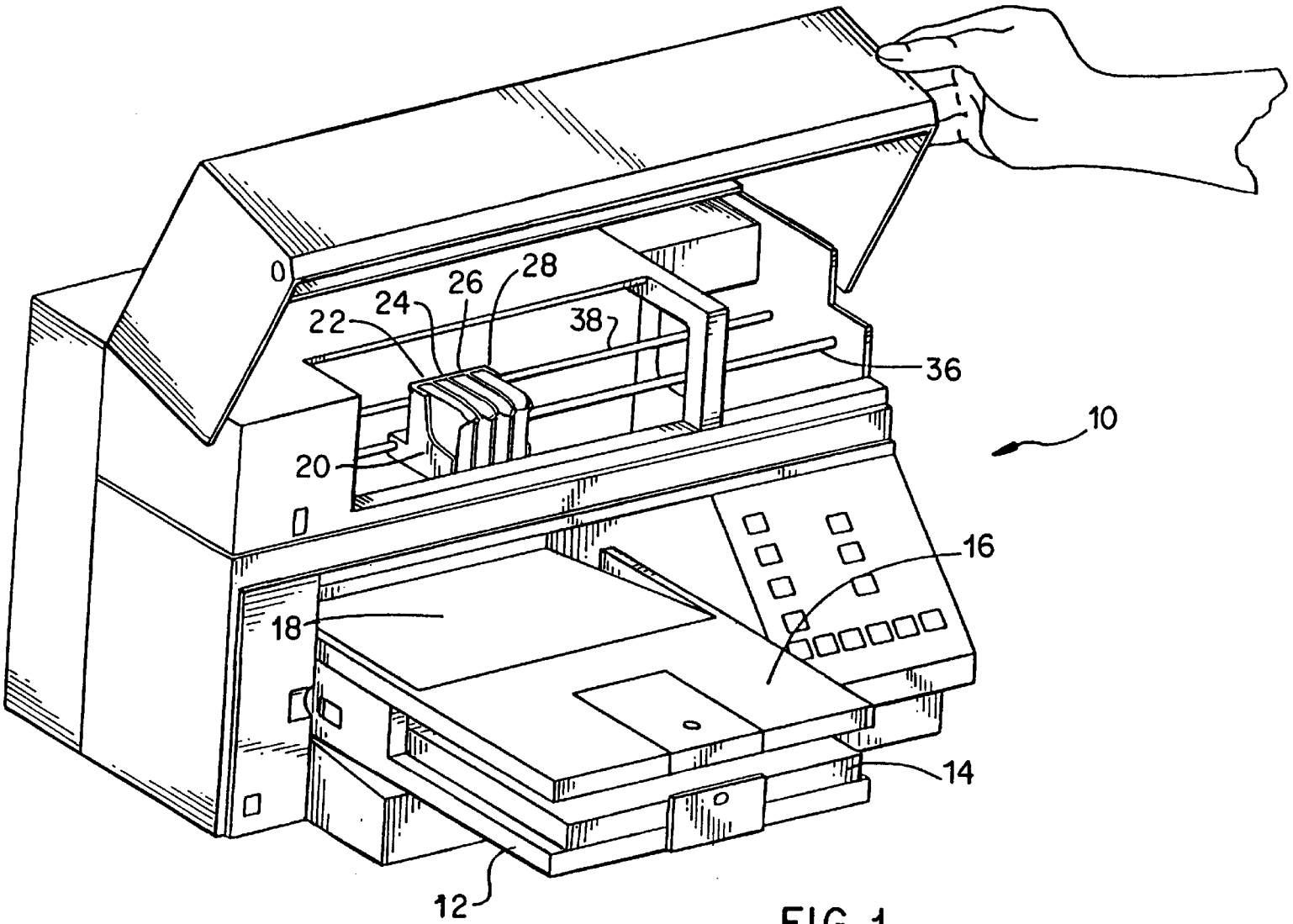
FIG. 1 is a perspective view of a type of inkjet printer which can incorporate the service station features of the present invention.
Figure 2:
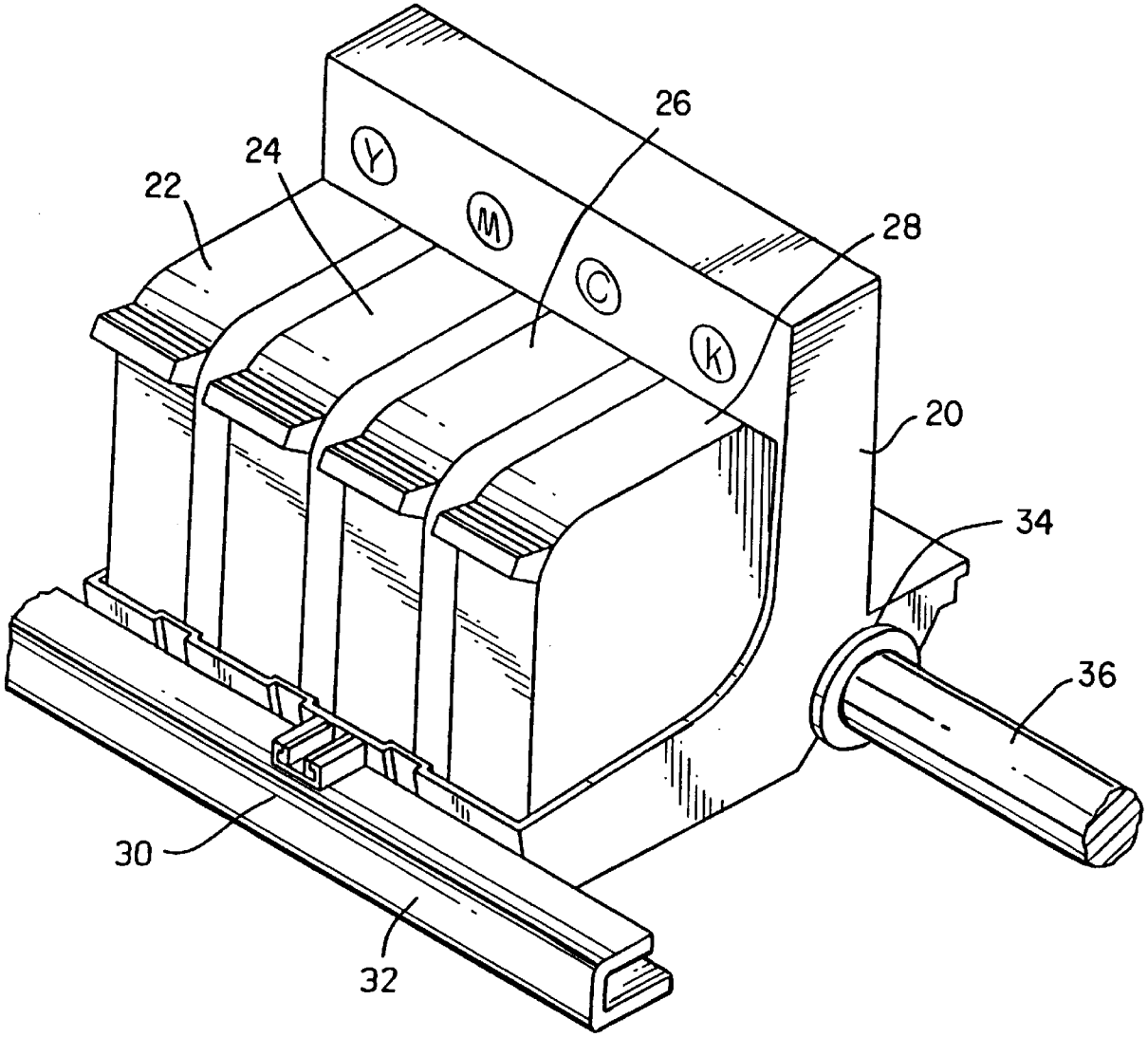
FIG. 2 is a perspective view of the carriage of the inkjet printer of FIG. 1, with yellow (Y), magenta (M), cyan (C) and black (K) inkjet cartridges removably mounted in the carriage.

Even though the invention can be used in any printing environment where text and/or graphics are applied to media using monochrome and/or color components, the presently preferred embodiment of the invention is used in an inkjet printer of the type shown in FIG. 1. In particular, inkjet printer 10 includes an input tray 12 containing sheets of media 14 which pass through a print zone, and are fed past an exit 18 into an output tray 16. Referring to FIGS. 1–2, a movable carriage 20 holds print cartridges 22, 24, 26, and 28 which respectively hold yellow (Y), magenta (M), cyan (C) and black (K) inks. The front of the carriage has a support bumper 30 which rides along a guide 32 while the back of the carriage has multiple bushings such as 34 which ride along slide rod 36. The position of the carriage as it traverses back and forth across the media is determined from an encoder strip 38 in order to be sure that the various ink nozzles on each print cartridge are selectively fired at the appropriate time during a carriage scan.

Of course, the invention is applicable to printers wherein cartridge printheads are completely or partially staggered relative to each other in the direction of the media advance axis in order to provide better throughput, avoid color bleed, etc. or may be in direct alignment to provide overlapping swaths during a single pass of the carriage over a print zone. The invention provides a unique way for selectively servicing only certain individual cartridges during a given time period, or for performing some service activities at one station and other service activities at another, or for performing all services at the same time in the same station, regardless of the staggered or aligned relationship of the printheads, and all without removing the printhead cartridges from a print carriage, as described in more detail below.

Figure 15:
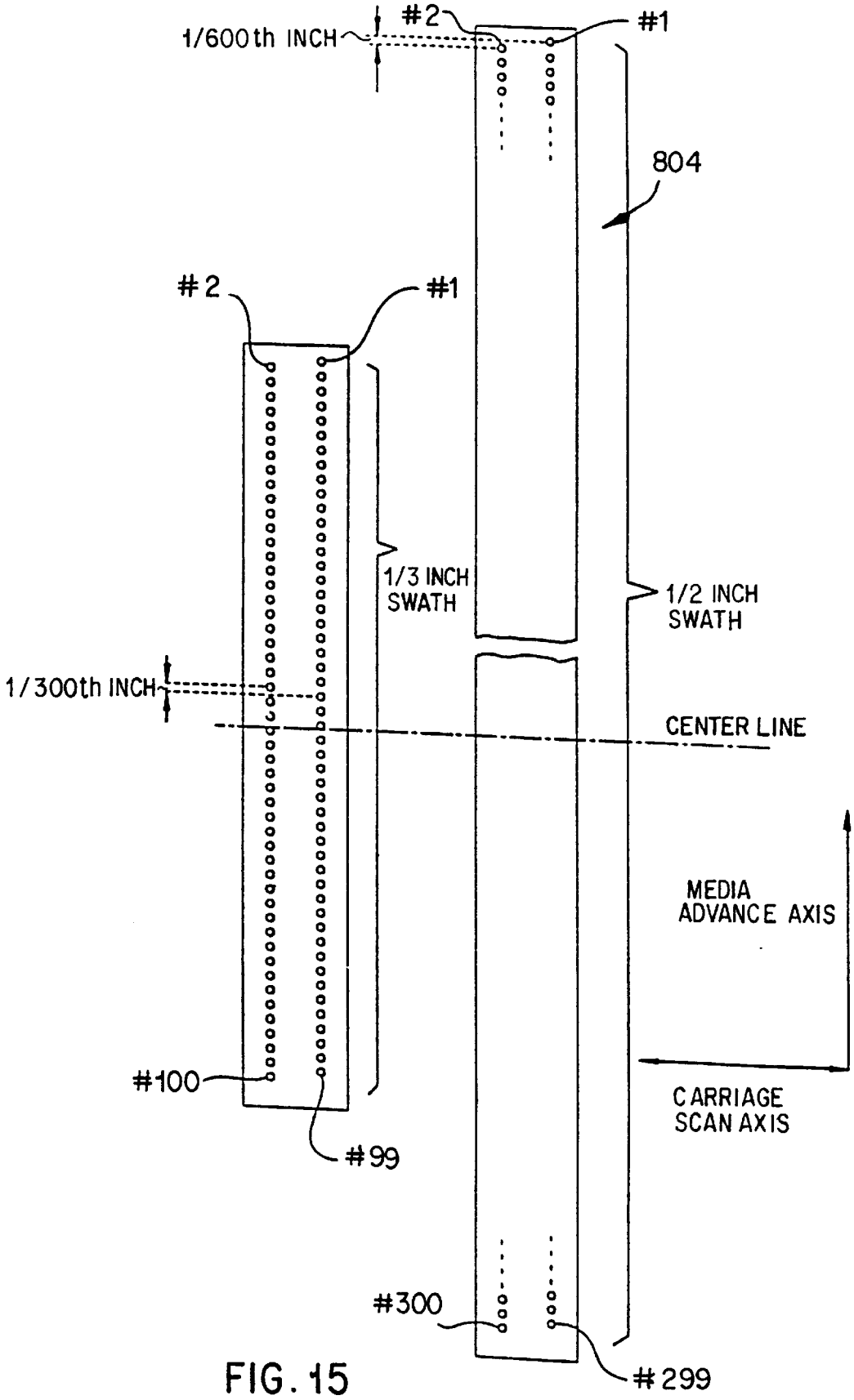
FIG. 15 schematically shows the nozzle arrays for a wide swath 600 dpi black ink printhead and a narrow swath 300 dpi color ink printhead, respectively, which can be serviced by the service station methods and techniques of the present invention.

While not limited to ink printheads having a particular type, size, resolution or configuration, the illustrated embodiment of the invention is used with ink cartridges having a double column of ink orifices which extend in the media advance axis of the printer (see FIG. 15).

In the illustrated embodiment, wiping of the three color printheads is accomplished in a conventional manner by stationary wipers having a narrow blade portion with a top edge for rubbing across the nozzle plate as the print cartridge moves past the wipers. Scraping the stationary wipers is also accomplished in a conventional manner by using a snout edge of the moving printhead. Capping of the three color ink printheads (as well as for the black ink printhead) is accomplished in a conventional manner by a capper having four sets of perimeter lips for completely surrounding the orifice pattern without overlapping any outer edge of the nozzle plate. Priming of the three color ink printheads (as well as for the black ink printhead) is accomplished in a conventional manner by a vacuum primer.

Figure 3:
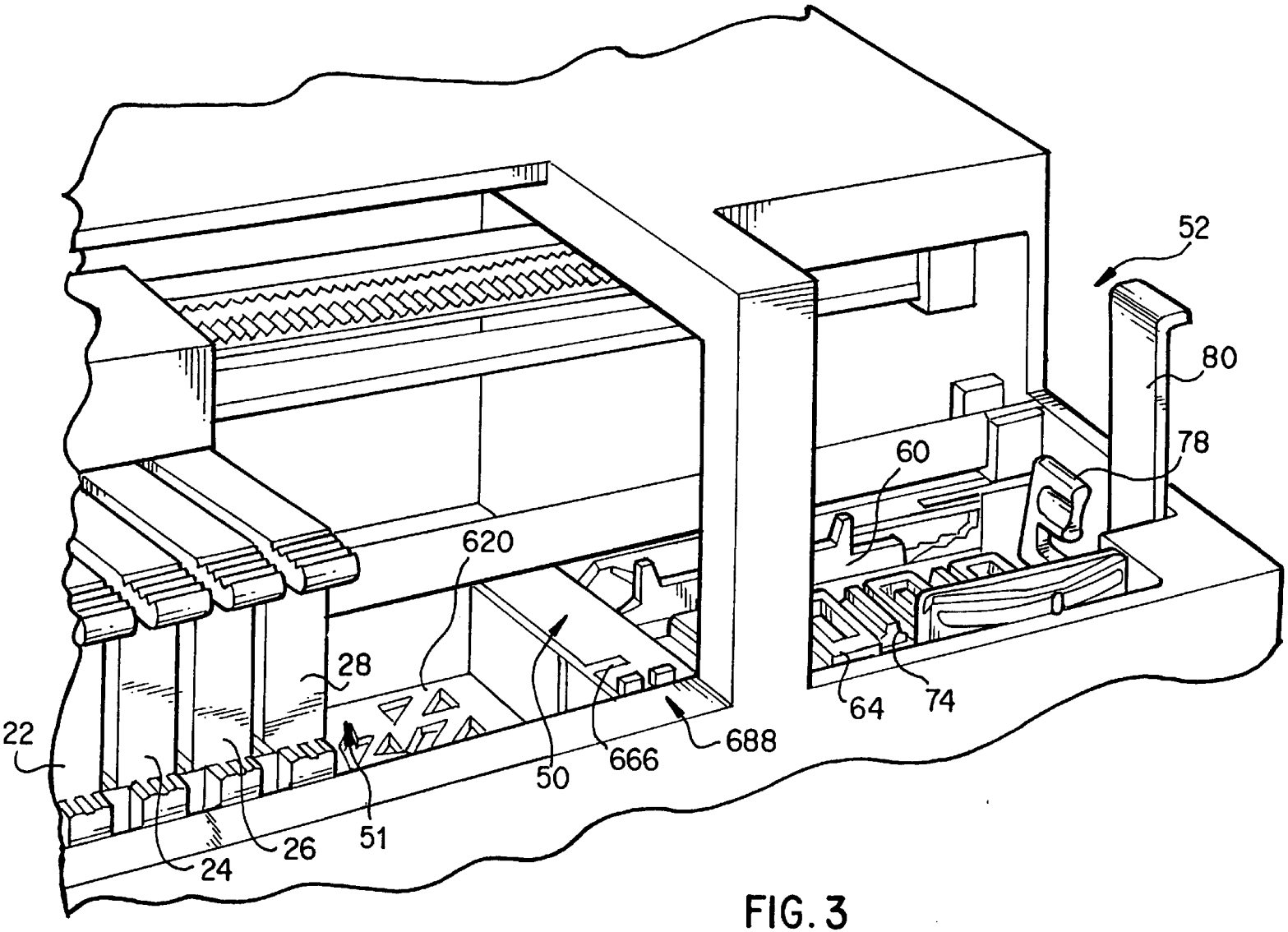
FIG. 3 is a close-up perspective view of a presently preferred embodiment of a service station unit which has been installed in the inkjet printer of FIG. 1.
Figures 4A, 4B:
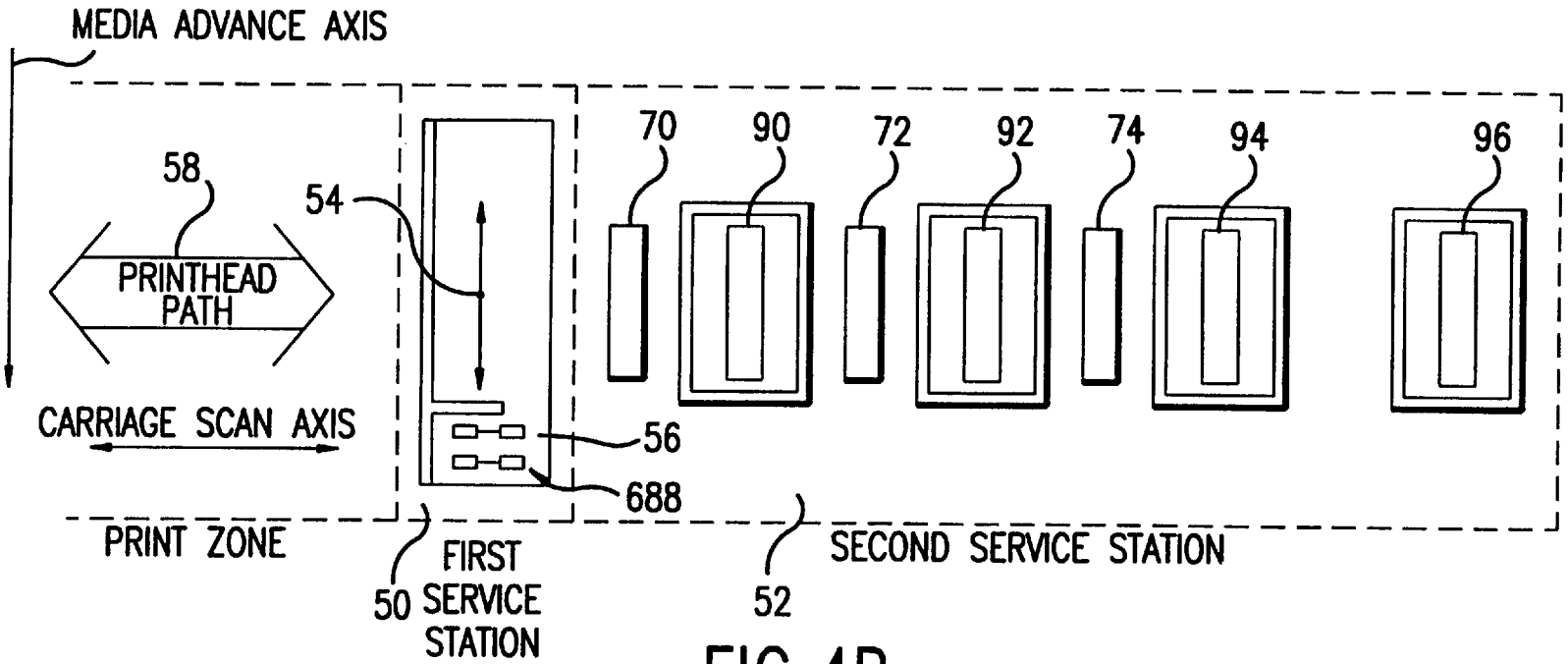
FIGS. 4A and 4B are tabular and schematic representations showing the allocation of printhead services between first and second service stations which are incorporated in the service station unit of FIG. 3.

However, as shown in FIGS. 3 and 4A–4B, the service station functions of the present invention are generally divided between a first service station 50 which is immediately on the right of a print zone 51 and a second service station 52 which is on the right of the first service station. The service functions of each are set forth in tabular form in FIG. 4A, and shown schematically in FIG. 4B. The direction of the translational back-and-forth wiping of the 600 dpi pigment based black ink printhead is identified by arrow 54 which is orthogonal to the carriage scan axis. Moreover, a home location 56 for parking wiper blade member 688 during an actual printing operation is located away from printhead path 58, to avoid interference with any of the printheads which extend into the service station section of the printer at the end of each printing swath.

Figure 5:
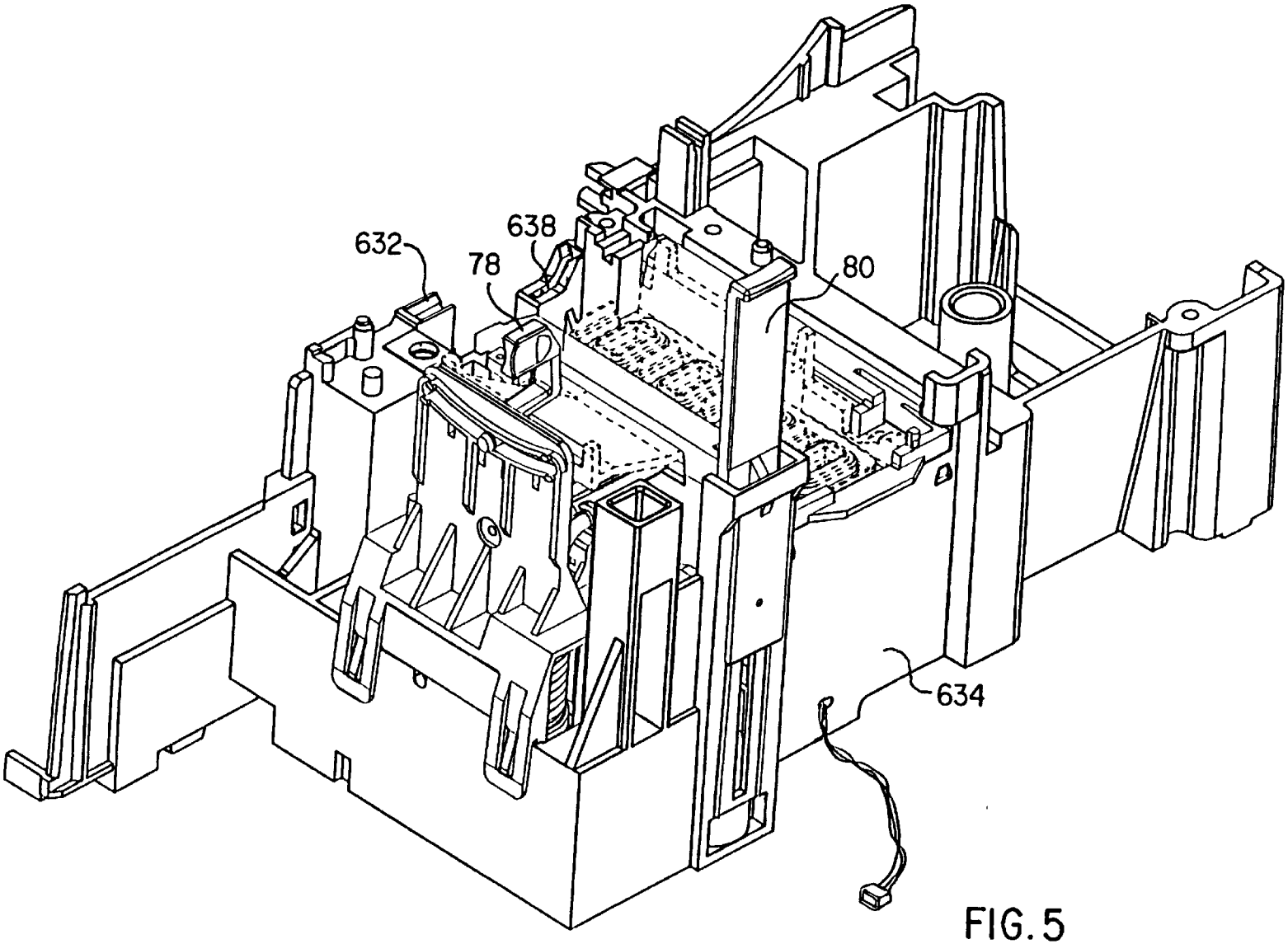
FIG. 5 is a perspective view of a housing portion of the service station unit of FIG. 3, with certain functional components of the second service station shown in dotted lines.
Figure 6:
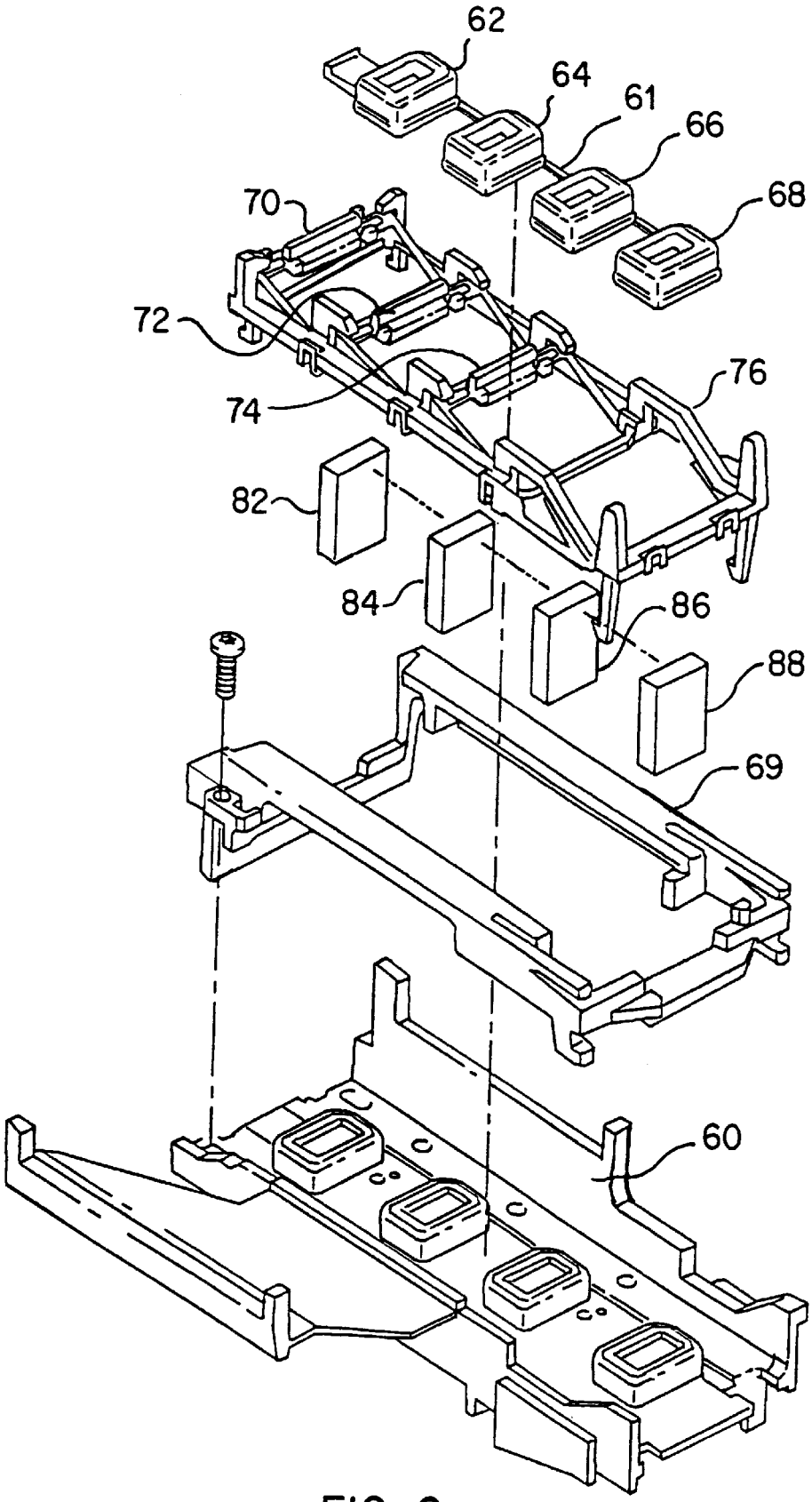
FIG. 6 is an exploded view of the functional service station components of the second service station, previously shown in dotted lines in FIG. 5.

Referring now to FIGS. 3, 5 and 6, the second service station 52 includes sled 60 having a bar 61 for holding caps 62, 64, 66, 68. When the carriage 20 is not being used for printing and is not in position at the first service station, the carriage moves all the way to the right to enable the caps to engage their respective printhead nozzle surfaces, thereby preventing the ink orifices in the printhead from drying out.

A wiper support structure 69 rests on the sled 60. Three wiper blades 70, 72, 74 are each mounted with spring loading on a frame 76 for the CYM printheads, respectively, to remove contaminants or crusted ink that may block the printhead nozzles. Each wiper is dedicated exclusively to only one of the color ink printheads, while wiper blade member 688 in the first service station is dedicated exclusively to only the black ink printhead.

The second service station also provides for selective priming each individual CYMK printhead by moving a selection lever 78 to align with an appropriate cartridge, and then manually depressing plunger 80. Air is drawn through one of filters 82, 84, 86, 88 through one of the central apertures 90, 92, 94, 96 (FIG. 4B) in each cap. Thus, if for some reason ink is no longer in the firing chamber for a particular printhead, a vacuum source (not shown) draws air through a central aperture and through the nozzle connected to a particular firing chamber, while the carriage is in the capping position in the second service station, to draw ink from an ink reservoir of the print cartridge into the firing chamber.

The "spitting" function for all four printheads is handled by the first service station. This is particularly important when cartridges have been capped for a lengthy period of time. Before resuming printing, a series of ink drops are fired in a spitting operation to clear crusted ink from the nozzles. Such spitting can be scheduled to correlate with a wiping operation for the black ink cartridge in the first station, as well as with a wiping operation for the color ink cartridges in the second station.

Figure 7:
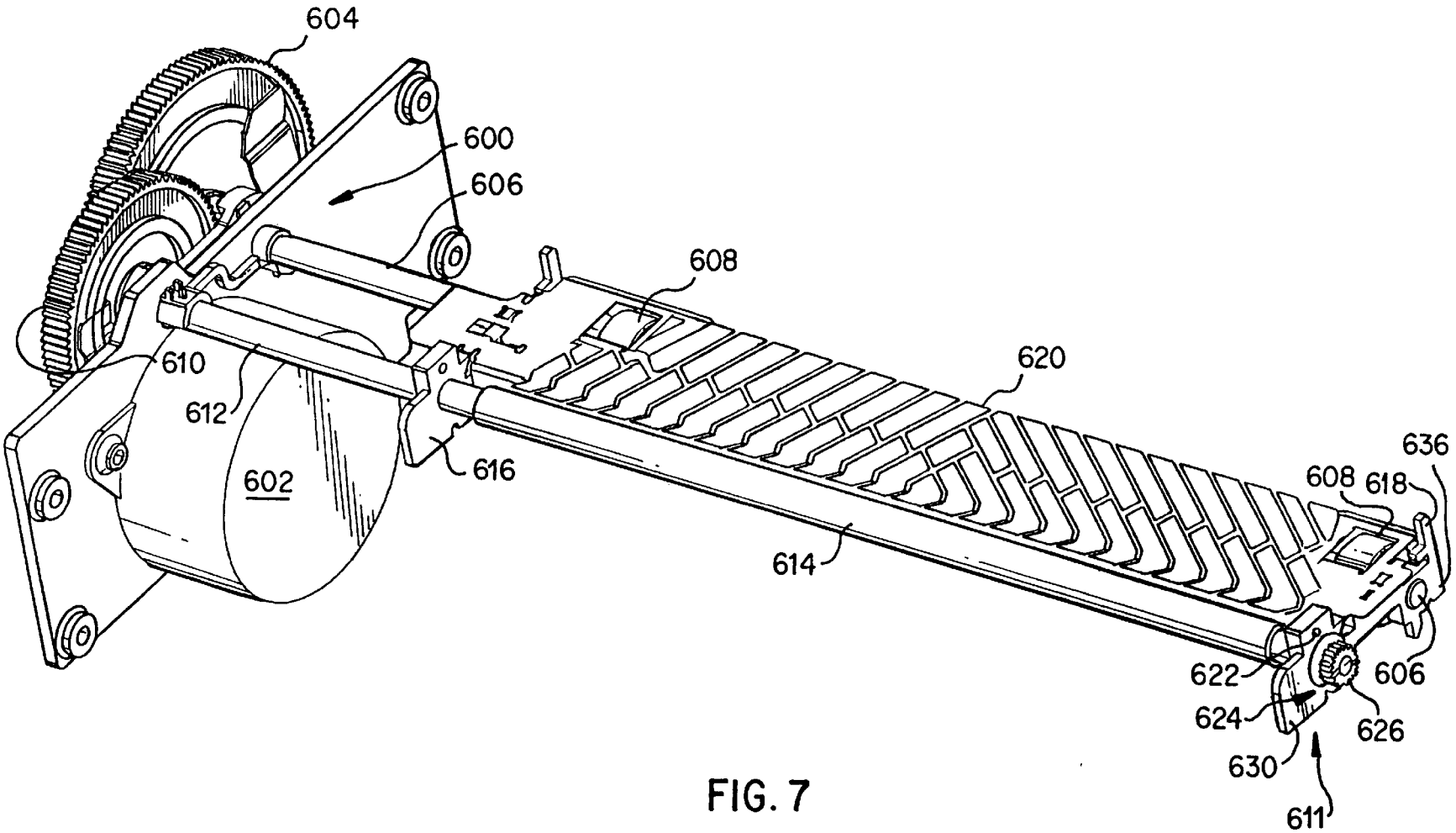
FIG. 7 is a perspective view showing a media advance drive roller system for a print zone, with a first service station drive gear mounted on one end of a media advance drive axle.
Figure 8:
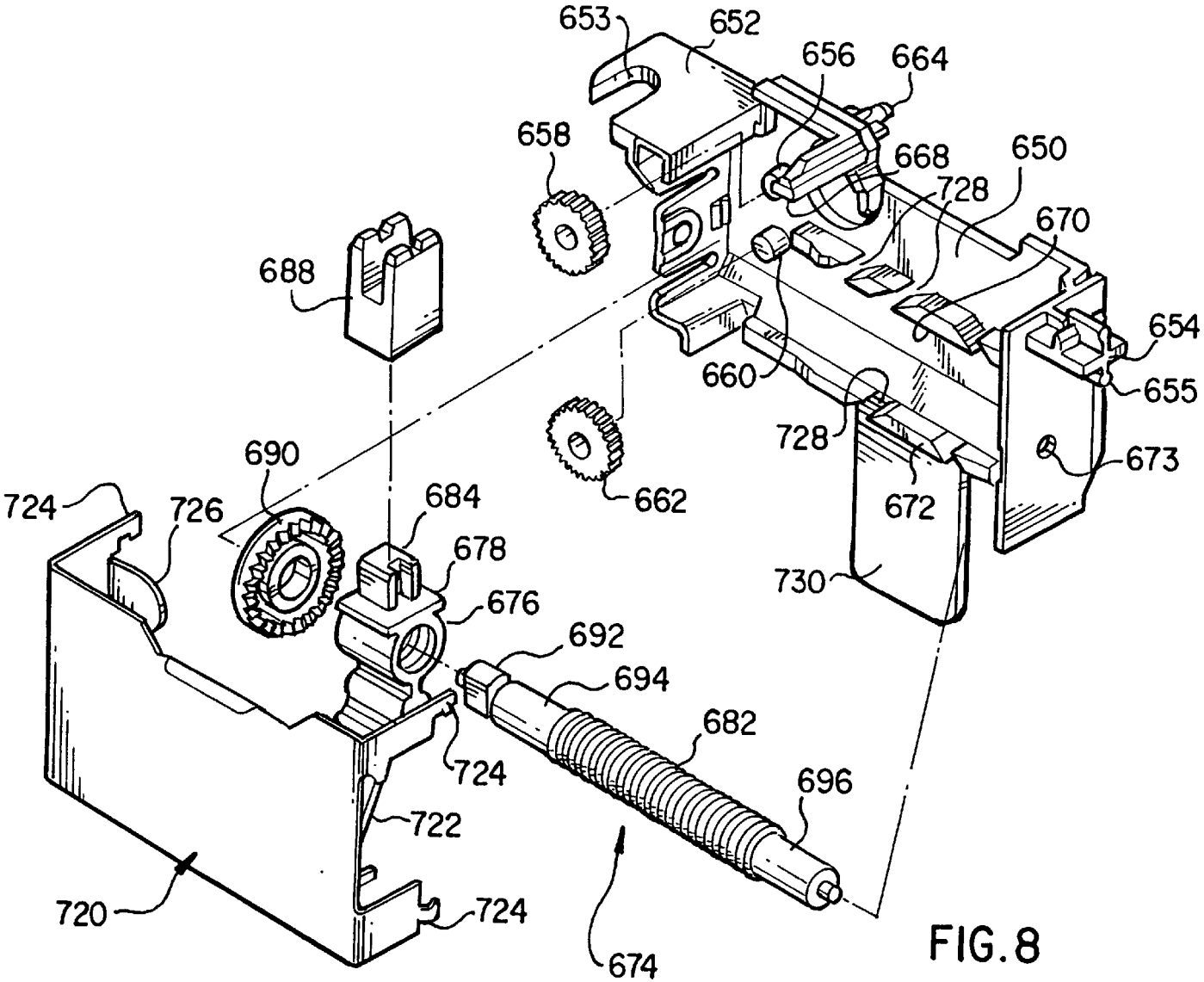
FIG. 8 is an exploded view of a first service station.
Figure 9:
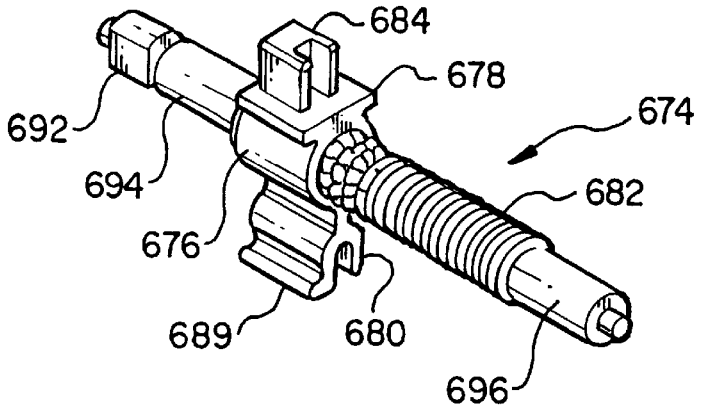
FIG. 9 shows a wiper base on a lead screw of the first service station.
Figure 10:
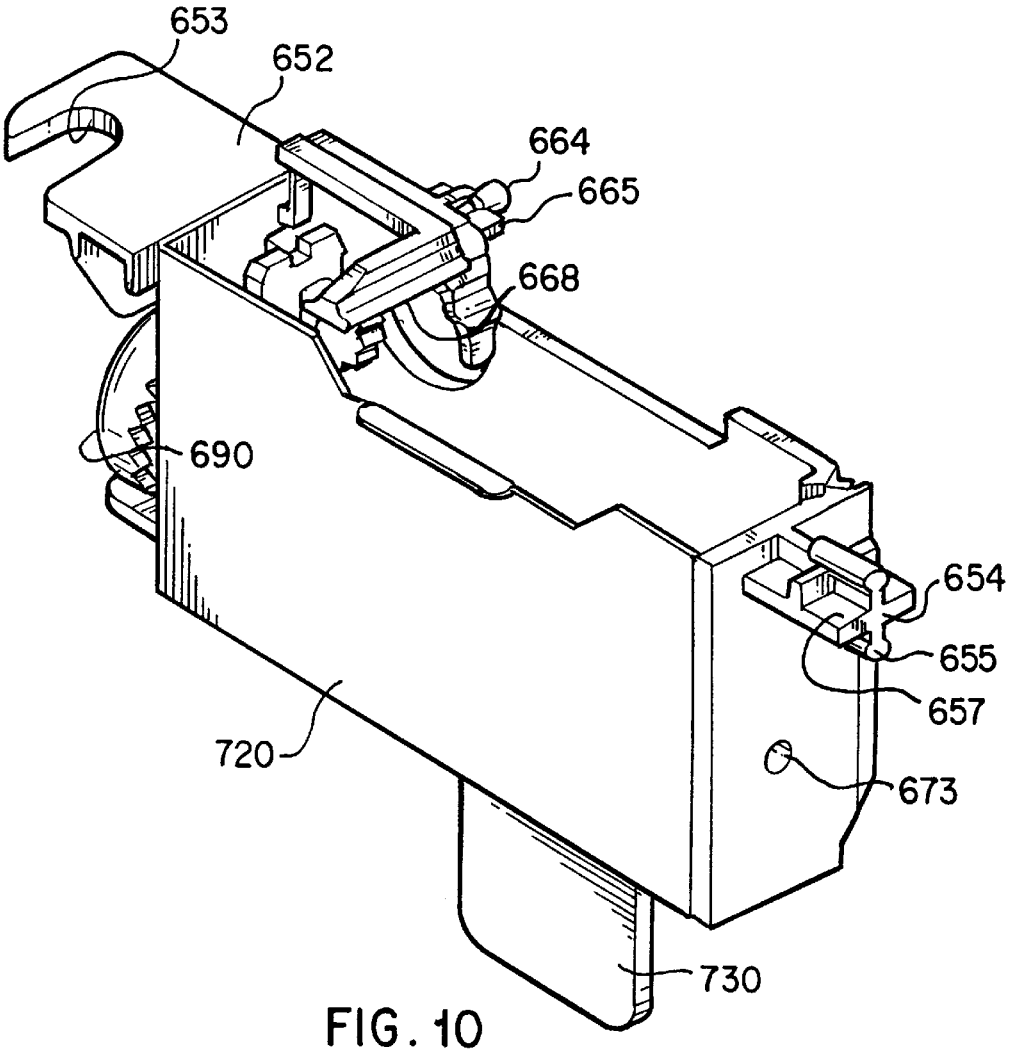
FIG. 10 is a perspective view of a first service station ready for installation on the printer, with a wiper unit in parked position.
Figure 11:
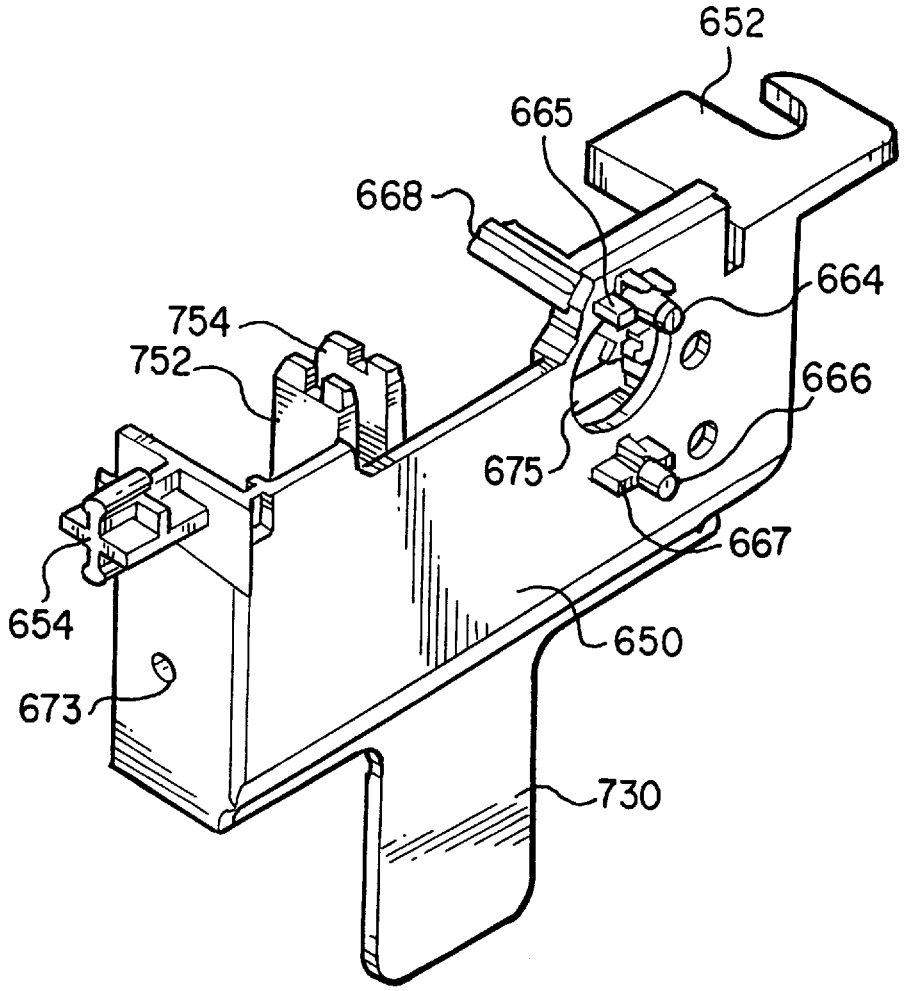
FIG. 11 is a perspective view of a housing portion of the first service station.

The perspective view of FIG. 7 shows how a first service station 50 can be actuated by a media advance motor, and also identifies one frame of reference for use in positioning a wiper unit in the first service station relative to the printhead and to the printer platen. In that regard, the media advance system for an inkjet printer with a heated print zone such as the Hewlett-Packard DeskJet 1200 C inkjet printer includes a vertical support plate 600, a stepper motor 602, a main drive gear 604 which drives a first axle 606 carrying primary drivewheels 608, a secondary drive gear 610 which drives a second axle 612 carrying secondary driveroller 614. Left and right bushing plates 616, 618 provide precise positioning of the drivewheels 608 and the driveroller 614 closely adjacent to a screen platen 620 which supports media passing through a heated print zone.

In the present invention, the right bushing plate 618 is modified to provide precise positioning of a unique first service station unit which is located next to the right bushing plate. The right bushing plate includes a top hole 622 and a bottom hole 624 for positional mounting of the first service station unit. A service station drive gear 626 is fixedly mounted on the right end of second axle 612. A front datum projection 630 fits into matching slot 632 on a service station chassis 634, while a rear datum projection 636 fits into another matching slot 638. Thus the service station chassis provides another frame of reference for positioning a wiper unit in the first service station relative to the Printhead and to the printer platen.

The structural details of the first service station unit are best shown in FIGS. 8–11. A housing 650 includes a front mounting tab 652 with screw slot 653, back mounting tab 654 with walls 655, 657, top bearing pin 656 for rotatably mounting top spur gear 658, bottom bearing pin 660 for rotatably mounting bottom spur gear 662, externally projecting mounting members (for holes 622, 624, respectively) such as a secondary top mounting pin 664 with spacer 665 and primary bottom mounting pin 666 with spacer 667, scraper 668, upper and lower cam surfaces 670, 672, and forward and rear bearing holes 673 for rotatably mounting a lead screw 674. A large opening 675 in the housing 650 allows drive gear 626 to extend through a housing wall for engagement with spur gear 658, thereby providing a gear train through bottom spur gear 662 to face gear 690. Chassis hole 677 is positioned for attaching alignment with screw slot 653, and chassis slot 679 is positioned for engagement with walls 655, 657.

A nut member is provided to form a wiper base 676 which has upper and lower cam followers 678, 680 which respectively track upper and lower cam surfaces 670, 672 as the wiper base moves in a back-and-forth linear motion along a central threaded portion 682 of the lead screw 674. An upwardly projecting key shaft 684 on the wiper base 676 is shaped to engage a matching interior mounting channel 686 of a removable wiper blade 688. An extending toe 689 on the wiper base provides asymmetry to avoid assembling the wiper base facing in the wrong direction on the leadscrew.

A face gear 690 is mounted on a square hub 692 of the lead screw 674 as the last element in a gear train to rotatably drive the lead screw. The lead screw 674 includes unthreaded front and back portions 694, 696 to provide temporary parking positions for the wiper base after it has traversed along the central threaded portion 682 during rotation of the lead screw by the face gear.

A cover 720 is sized and shaped to fit together with the housing 650 to form a spittoon in the first service station. The cover includes a front spring arm (not shown) and a back spring arm 722 to urge the wiper base into engagement with the central threaded portion 682 during appropriate time periods of the wiping procedure. Arm hooks 724 are provided for engagement with matching slots on the housing, and tab plates 726 serve to hold the spur gears 658, 662 in position on the housing. To facilitate movement of the wiper member 688 back and forth along the lead screw, slots 728 in both upper and lower cam surfaces 670, 672 allow ink to descend down into a bottom spittoon area (not shown) where an enlarged diaper pad absorbs excess ink. Also, an elongated wicking member 730 extends downwardly from the housing to help draw residual liquid ink down and away from important moving printer parts and away from the print zone. The back-and-forth movement of the wiper member 688 also helps to avoid crippling buildup of ink in the spittoon.

Figure 12B:
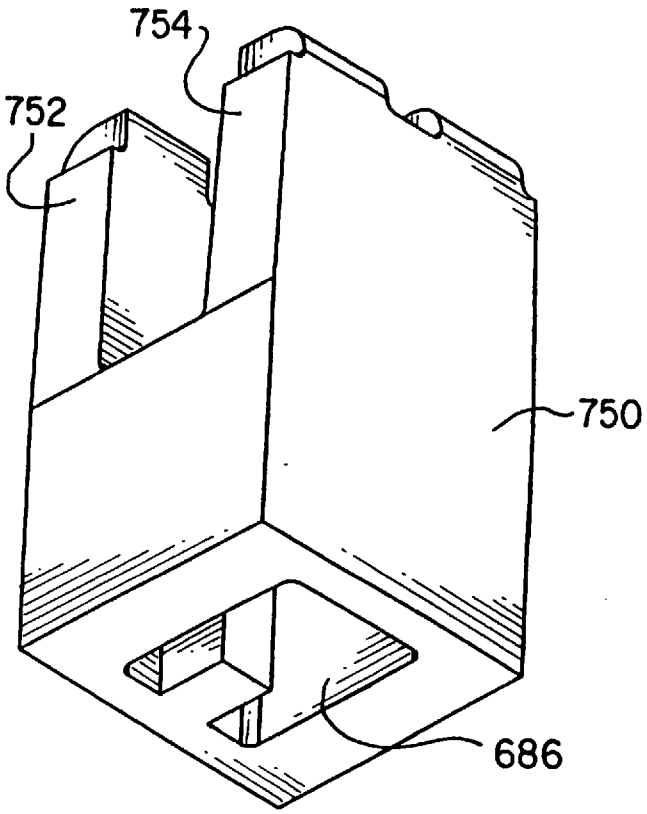
FIGS. 12A and 12B are enlarged perspective top and bottom views, respectively, of a wiper blade component of the first service station.
Figure 12A:
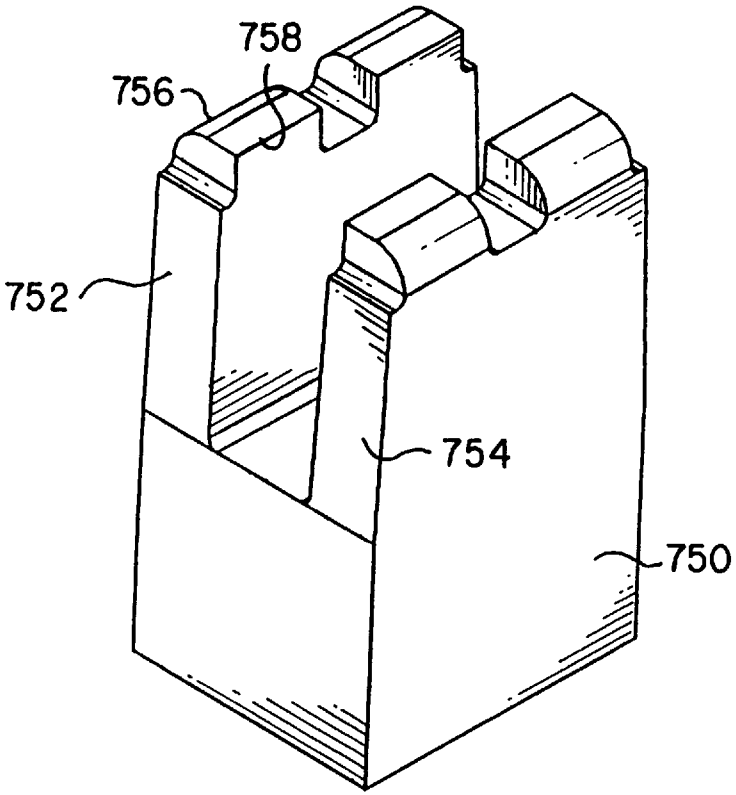
Figure 13:
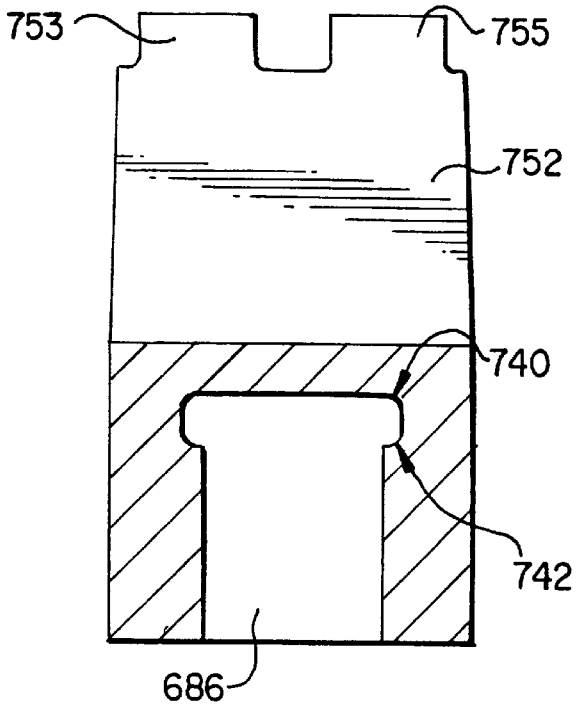
FIG. 13 is a partially sectional view showing an interior mounting channel of the wiper blade component of FIGS. 12A and 12B.
Figure 14:
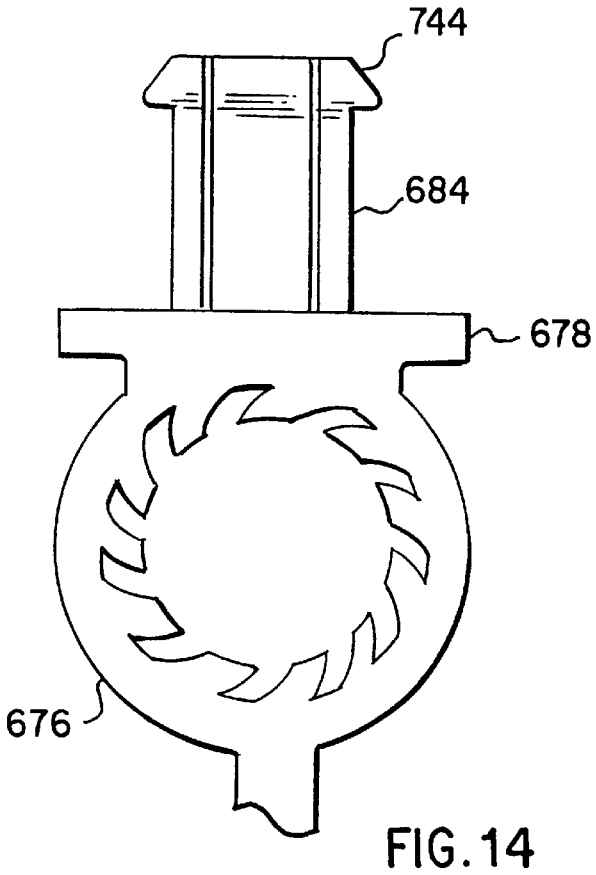
FIG. 14 is a partial side view of a wiper base showing a key shaft for engagement with the interior mounting channel of FIG. 13.

As shown in FIGS. 12A–12B and 13, secure but removable attachment of a wiper blade member 750 made with an elastomer material such as EPDM rubber is provided by an end wall 740 and a lateral headwall 742 for receiving and engaging splayed head 744 on wiper base 684 (FIG. 14). Wiper blade member 750 includes successive wiper blades 752, 754 which are split to form separate spaced apart wiping sections 753, 755. Each section presents a rounded edge 756 and a sharp edge 758 to sequentially wick ink from orifices onto a nozzle surface of the printhead with the rounded wiper edge and immediately thereafter remove ink from the nozzle surface of the printhead with the sharp wiper edge. By positioning the successive wiper blades in a mirror image orientation, the rounded wiper edge necessarily engages the nozzle surface first and the sharp edge engages the nozzle surface immediately thereafter. Thus, wet ink resolubalizes any dried ink on the nozzle surface, and the sharp edge immediately cleans the surface before any dried ink buildup occurs. The aforementioned split configuration is particularly designed for use with inkjet nozzle arrays having two columns of ink orifices, such as a ⅓ inch swath printhead 802 with approximately one hundred nozzles in a 300 dpi array and/or a ½ inch swath printhead 804 with approximately three hundred nozzles in a 600 dpi array (see FIG. 15).

In accordance with all of the foregoing, the first service station provides for the unique wiping/scraping procedure as set forth in the flow chart of FIGS. 16A–16B. It will be understood from the self-explanatory flow chart that initially the wiper blades are parked in an idle position with the wiper base in a home position on the unthreaded portion of the lead screw, even though the lead screw continues to rotate during a printing operation After the printing operation is completed and the media is advanced out of the print zone, a scheduled wiping operation is commenced by reversing the stepper motor to activate the first service station. As the threads of the lead screw engage the wiper nut, the flexible wiper blade edges are first driven across the rigid scraper to clean them in order to avoid damaging the nozzle surface, and then are driven across the ink orifices for the wicking/cleaning actions previously described. The cycle is completed by reversing the stepper motor to again accomplish the wicking/cleaning actions followed by the step of scraping the flexible wiper blade edges. The threaded wiper base then moves into an idle or parked position due to the clutch action of the unthreaded portion of the lead screw. It is to be noted that while the accumulation of ink on a nozzle surface of the printhead is normally an undesirable thing, in this instance the wicking of ink from a nozzle array by the rounded edge of the leading wiper blade is very important here to achieve successful cleaning of the nozzle surface by lubricating the nozzle surface and by resolubalizing any residual dried ink on the nozzle surface.

The different wiping speeds and the time required to perform each full wiping cycle in the preferred embodiment of the invention are shown in the timing diagram of FIG. 17. Thus, translational wiping is accomplished in both directions at different speeds as determined by print quality reliability standards.

It will be appreciated by those skilled in the art that the various datum mechanical interconnects precisely position the wiping mechanism of the first service station. If the media advance axis is called the X-axis, then primary positioning in the X direction is provided by lower pin 666. A first rotational positioning is provided by wall 657 and tab 652. A second rotational positioning is provided primarily by spacers 665, 667. Additional rotational positioning about the Z-axis is provided by lower wall 655 and spacers 665, 667.

By providing specialized wiping services to a high resolution wide swath pigment based black ink pen, this invention allows higher resolution and speed to occur for frequently printed features such as text and the most frequent color components of graphics—viz, black. Thus by printing these frequent features and components faster and at a higher resolution, the entire page is faster and of higher quality and is more comparable with laser printing performance (8+pages per minute) and laser printing quality (600 dpi resolution).

It should be understood that the foregoing description is only illustrative of the invention. Various alternatives and modifications may be made by those skilled in the art without departing from the spirit of the invention. Accordingly, the present invention is intended to include all such alternatives, modifications and variations which fall within the scope of the following claims.

We claim as our invention:

1. An inkjet printer for use with at least one printhead with multiple orifices on a nozzle surface for applying liquid ink to media in a print zone, comprising:

a carriage for holding the printhead;

carriage motor means for moving said carriage in a carriage scan direction across the print zone to a service station, with the printhead moving along a printhead path;

a wiper unit in said service station;

mounting means in said wiper unit for holding a wiper member in a predetermined upright position; and actuation means for moving said wiper member back and forth in forward and reverse linear directions orthogonal to said carriage scan direction to perform a translational wiping of the nozzle surface of the printhead while said carriage is in a stop position in said service station.

2. The inkjet printer of claim 1 which further includes wiper motor means connected to said actuation means for moving said wiper.

3. The inkjet printer of claim 2 wherein said wiper motor means also advances the media through the print zone.

4. The inkjet printer of claim 1 wherein said wiper unit includes a spittoon for receiving ink drops generated from the printhead during a spitting operation at said service station.

5. The inkjet printer of claim 1 wherein said wiper unit includes a scraper for removing residual ink from said wiper member.

6. Th einkjet printer of claim 1 wherein said wiper unit includes a rest area for parking said wiper member in a location away from said printhead path.

7. The inkjet printer of claim 1 wherein said actuation means includes an advance device connected to said wiper member for moving said wiper member in a back-and-forth direction across the nozzle surface of the printhead.

8. The inkjet printer of claim 7 wherein said advance device includes a clutch mechanism for engaging said wiper member to move said wiper member through said printhead path during a wiping operation and for disengaging said wiper member to allow said wiper member to be in a parked position away from said printhead path before and/or after a wiping operation.

9. The inkjet printer of claim 7 wherein said advance device includes a rotatable lead screw extending orthogonally across said printhead path.

10. The inkjet printer of claim 1 wherein said mounting means includes multiple tabs on said wiper unit for positioning said wiper member on the printer in a predetermined position relative to the printhead.

11. The inkjet printer of claim 10 which further includes a platen for supporting the media in the print zone, and wherein said multiple tabs position said wiper member relative to said platen.

12. An inkjet printer having a printhead mounted in a carriage which moves in a carriage scan direction along a printhead path between a print zone and a service station, comprising:

a motor on the printer;

a drive roller connected to said motor by a connection apparatus to move media through the print zone;

an actuator for moving said wiper back and forth in forward and reverse linear directions orthogonal to the carriage scan direction and defined by a nozzle surface on the printhead in order to wipe a nozzle surface on the printhead when the carriage is in a stop position in the service station; and a gear train connected between said motor and said actuator for moving said wiper back and forth in said linear directions.

13. The inkjet printer of claim 12 wherein said actuator imparts translational motion to said wiper to move said wiper back and forth across said nozzle surface of the printhead.

14. The inkjet printer of claim 12 wherein said actuator allows said wiper to remain away from the printhead path in an idle position while the printhead is moving through the print zone.

15. A method of servicing an inkjet printhead having a printhead in a carriage which moves in a carriage scan direction along a printhead path through a print zone, comprising the following steps:

moving the carriage to a stop position in a printer service station without removing the printhead from the carriage;

rotating an actuation device to move a wiper blade in a linear direction through the printhead path thereby wiping ink orifices on a nozzle surface on the printhead;

counter-rotating the actuation device to move the wiper blade in an opposite linear direction thereby wiping back across the ink orifices on the nozzle surface; and parking the wiper blade in an idle position away from the printhead path before and/or after completion of said wiping step.

16. The method of claim 15 which further includes scraping residual ink from the wiper blade before and/or after completion of said wiping step.

17. The method of claim 15 which further includes rotating the actuation device to scrape residual ink from the wiper blade before commencement of said wiping step.

18. The method of claim 15 which further includes rotating the actuation device to scrape residual ink from the wiper blade after completion of said wiping.

19. The method of claim 15 which further includes preventing movement of the wiper blade in the linear direction after completion of said wiping step by invoking a clutching action on the actuation device.

20. The method of claim 15 which further includes preventing movement of the wiper blade in the linear direction before commencement of said wiping step by invoking a clutching action on the actuation device.

21. An inkjet printer having a carriage for holding a printhead which moves along a printhead path in a carriage scan direction across a print zone, comprising:

a service station located on the printhead path and displaced from the print zone;

a wiper member in said service station, including a movable base of a first material holding a wiper blade of a second material in an upright position; and actuation means engageable with said base for moving said wiper blade back and forth in a forward linear wiping direction and in a reverse linear wiping direction, said forward and reverse linear wiping directions orthogonal to said carriage scan direction, across a nozzle surface of the printhead.

22. The inkjet printer of claim 21 which further includes means for removably mounting said wiper blade on said base.

23. The inkjet printer of claim 21 wherein said actuation means includes a lead screw and said base includes a nut which is rotatably mounted on said lead screw.

24. The inkjet printer of claim 23 wherein said service station includes a gear train connected to said lead screw;

a casing member for mounting said gear train and said lead screw, said casing member including multiple tabs for attachment to said printer; and a side plate member attachable to said casing member to form with said casing member a spittoon enclosure in said service station.

25. An inkjet printer for use with at least one printhead with multiple orifices on a nozzle surface for applying liquid ink to media in a print zone, comprising:

a carriage for holding the printhead;

carriage motor means for moving said carriage in a carriage scan direction across the print zone to a service station, with the printhead moving along a printhead path;

a wiper unit in said service station;

mounting means in said wiper unit for holding a wiper member in a predetermined upright position;

actuation means for moving said wiper member in a linear direction to perform a translational wiping of the nozzle surface of the printhead while said carriage is in a stop position in said service station; and wherein said mounting means includes a cam surface in said wiper unit for defining said predetermined upright position, and cam follower means on said wiper means for abutting against said cam surface means during said translational wiping of said nozzle surface.

26. A method of servicing an inkjet printhead having a printhead in a carriage which moves in a carriage scan direction along a printhead path through a print zone, comprising the following steps:

moving the carriage to a stop position in a printer service station without removing the printhead from the carriage;

rotating an actuation device to move a wiper blade in a linear direction through the printhead path thereby wiping ink orifices on a nozzle surface on the printhead;

preventing movement of the wiper blade in the linear direction after completion of said wiping step by invoking a clutching action on the actuation device, said clutching action being deactivated by applying a spring force to the wiper blade during said rotating step; and parking the wiper blade in an idle position away from the printhead path before and/or after completion of said wiping step.

27. A method of servicing an inkjet printhead having a printhead in a carriage which moves in a carriage scan direction along a printhead path through a print zone, comprising the following steps:

moving the carriage to a stop position in a printer service station without removing the printhead from the carriage;

rotating an actuation device to move a wiper blade in a linear direction through the printhead path thereby wiping ink orifices on a nozzle surface on the printhead;

counter-rotating the actuation device to move the wiper blade in an opposite linear direction thereby wiping back across the ink orifices on the nozzle surface;

preventing movement of the wiper blade in the opposite linear direction after completion of said wiping step by invoking a clutching action on the actuation device, said clutching action being deactivated by applying a spring force to the wiper blade during said rotating step; and parking the wiper blade in an idle position away from the printhead path before and/or after completion of said wiping step.

28. An inkjet printer having a service station and at least one printhead mounted on a carriage moveable along a rectilinear path of travel across a print zone to a stop position in the service station, comprising:

an upstanding wiper member mounted in the service station and moveable in a linear direction to perform a translational wiping of the printhead while the carriage is in the stop position; and a motor driven cam coupled to said upstanding wiper member moves said wiper member in said linear direction to facilitate the translational wiping of the printhead.

29. An inkjet printer according to claim 28, further comprising:

a mounting arrangemgent having a cam surface coupled to said motor driven cam holds said wiper in a predetermined upstanding position relative to the printhead to help facilitate a printhead cleaning process as said wiper member is moved in said linear direction; and a cam follower responsive to movement of the motor driven cam abutts against said cam surface during said translational wiping of the printhead.

30. An inkjet printer according to claim 28, further comprising:

a motor coupled to said cam; and a rotatable actuation device coupled between said wiper member and said motor to facilitate linear movement of said wiper member in said linear direction along a wiper path of travel.

31. An inkjet printer according to claim 30, further comprising:

a clutch arrangement coupled to said rotatable actuation device prevents movement of said wiper member beyond a predetermined location in said wiper path of travel and enables said wiper member to move in an opposite linear direction to effect a rectilinear wiping action by the wiper member across the printhead.

32. An inkjet printer according to claim 31, comprising:

a translational arrangement coupled to said motor facilitates wiper member movement to a parked idle position away from the printhead once the wiper member completes said rectilinear wiping action back and forth in forward and reverse directions across the printhead.

* * * * *

UNITED STATES PATENT AND TRADEMARK OFFICE

CERTIFICATE OF CORRECTION

PATENT NO : 5,886,714

DATED : March 23, 1999

INVENTOR(S) : Burney et al.

It is certified that error appears in the above-identified patent and that said Letters Patent is hereby corrected as shown below:

At Column 7, line 65, delete "Th einkjet" and insert in lieu thereof --The inkjet--.

Signed and Sealed this

Thirty-first Day of August, 1999

*Attest:*

Q. TODD DICKINSON

*Attesting Officer*

*Acting Commissioner of Patents and Trademarks*